US005558492A

United States Patent [19]

Kieffer

[11] Patent Number: 5,558,492

[45] Date of Patent: Sep. 24, 1996

[54] PAINT SPRAYER WITH INLET SILENCER

[75] Inventor: Joseph W. Kieffer, Maple Grove, Minn.

[73] Assignee: Wagner Spray Tech Corporation, Minneapolis, Minn.

[21] Appl. No.: 420,150

[22] Filed: Apr. 11, 1995

Related U.S. Application Data

[62] Division of Ser. No. 36,539, Mar. 22, 1993, Pat. No. 5,423,395.

[51] Int. Cl.[6] ..... F04D 29/66

[52] U.S. Cl. ..... 415/119; 415/208.1; 181/202; 181/279; 181/280

[58] Field of Search ..... 415/182.1, 183, 415/208.1, 119; 181/202, 279, 280

[56] References Cited

U.S. PATENT DOCUMENTS

| | | | |
|---|---|---|---|
| 4,122,913 | 10/1978 | Stemp | 181/279 |
| 4,146,112 | 3/1979 | Usry | 181/202 |
| 4,227,898 | 10/1980 | Kamekawa | 181/279 |
| 4,325,149 | 4/1982 | Moreland | 415/182.1 |
| 4,733,750 | 3/1988 | Poirier et al. | 181/202 |
| 5,336,046 | 8/1994 | Hashimoto et al. | 415/119 |

*Primary Examiner*—John T. Kwon
*Attorney, Agent, or Firm*—Faegre & Benson LLP

[57] ABSTRACT

A silencer for the primary air intake port of an air compressor which includes (a) a housing defining a cylindrical chamber with an inlet orifice at one end and an outlet orifice at the other and (b) a baffle including (i) a substantially cylindrically shaped portion generally concentrically positioned within the chamber which divides the chamber into a central cylindrical compartment in fluid communication with the outlet orifice and an annular compartment in fluid communication with the inlet orifice, (ii) an opening through the cylindrical shaped portion of the baffle proximate the inlet orifice for providing fluid communication between the central cylindrical compartment and the annular compartment, and (iii) a wing extending generally radially from the cylindrically shaped portion of the baffle into contact with the housing sidewall between the inlet orifice and the opening forcing air flowing into the chamber from the inlet orifice to travel along substantially the entire circumference of the annular compartment before entering the central cylindrical compartment through the opening in the baffle.

6 Claims, 4 Drawing Sheets

PAINT SPRAYER WITH INLET SILENCER

This is a divisional of U.S. patent application Ser. No. 08/036,539 filed Mar. 22, 1993, now U.S. Pat. No. 5,423, 395.

FIELD OF THE INVENTION

The invention broadly relates to industrial air compressors. More specifically, the invention relates to air compressors furnished with sound absorptive silencing equipment.

BACKGROUND

Typical paint spraying equipment employs an air compressor for generating the high velocity air flow required to siphon, entrain and atomize paint.

Typical paint spraying equipment usually retains the air compressor within a main housing for purposes of protecting the compressor against damage, preventing a user from accidently contacting the air compressor, and facilitating transportation of the unit.

Despite retention of the compressor within a housing, the noise level emitted by ordinary commercial air compressors makes it difficult for a user of the equipment to verbally communicate with others and can be audibly uncomfortable for those who must work near the equipment for extended periods of time. The primary sources of noise in a paint sprayer with a well balanced air compressor are believed to be the primary air intake port and the pressurized air venting port. An additional source of noise in paint sprayers with an unbalanced air compressor is believed to be the amplification of compressor vibration by the main housing.

Accordingly, a substantial need exists for a quieter paint sprayer having substantially the same performance characteristics as typical commercial paint sprayers.

SUMMARY

Quieted Air Compressor

The quieted air compressor includes an air compressor retained within a segregation enclosure which is equipped with one or more noise abating options including (a) a silencer in fluid communication with the primary air intake port in the compressor, (b) a muting tube in sealed fluid communication with a venting port for the pressurized air, (c) a sound absorbent shell lining the segregation enclosure, and (d) a gasketed opening through the segregation enclosure which permits extension of the motor housing out from the segregation enclosure without contacting the enclosure so as to prevent the transference and amplification of air compressor vibrations to the segregation enclosure.

Silencer

The silencer includes (a) a housing defining a chamber and including a sound absorbent material, (b) an inlet orifice through the housing, (c) an outlet orifice through the housing, and (b) a baffle constructed of a sound absorbent material and positioned within the silencing chamber so as to create a circuitous path from the inlet orifice to the outlet orifice.

Specifically, the baffle includes (aa) a substantially cylindrically shaped portion positioned concentrically within the silencing chamber which divides the silencing chamber into a central cylindrical compartment and an annular compartment, (bb) an opening through the cylindrically shaped portion which provides fluid communication between the central cylindrical compartment and the annular compartment, and (cc) a wing extending generally radially from the cylindrically shaped portion of the baffle into sealing contact with the housing so as to block air flow within the annular compartment. The inlet orifice is positioned for direct fluid communication with the annular compartment while the outlet orifice is positioned for direct fluid communication with the central cylindrical compartment. The wing is positioned within the annular compartment between the inlet orifice and the opening through the baffle such that air flowing into the silencing chamber through the inlet orifice must travel along substantially the entire circumference of the annular compartment before entering the central cylindrical compartment through the opening.

The housing and baffle may be either constructed solely of a suitable sound absorbing material or include a framework which is lined with a sound absorbing material.

Muting Tube

The air compressor includes a conduit in fluid communication with the air discharge port of the air compressor for directing the flow of pressurized air from the compression chamber. The conduit includes a venting port for continuously venting pressurized air from the conduit during operation of the compressor.

A muting tube is configured and arranged in sealed fluid communication with the venting port for directing the flow of vented pressurized air from the conduit and attenuating the noise generated by the discharged of pressurized air through the venting port. The muting tube has an internal diameter which increases as the tube extends away from the venting port until the internal diameter of the tube is increased by a factor of at least about 1.5.

Shell

A shell of acoustically insulating material is provided along the walls of the segregating enclosure for reducing the sound level emanating from the enclosure.

Gasketed Opening

The motor housing extends outside of the segregation enclosure through a hole in the enclosure for circulating cooling air from outside the enclosure through the motor housing. The hole is sized to provide an annular gap around the motor housing and thereby prevent the transmission of air compressor vibrations from the motor housing to the segregation enclosure.

A resilient gasket is positioned over the annular gap for sealing the gap to air flow without transmitting substantial vibrational movement from the motor housing to the segregation enclosure.

CONSTRUCTION

Figure 1:
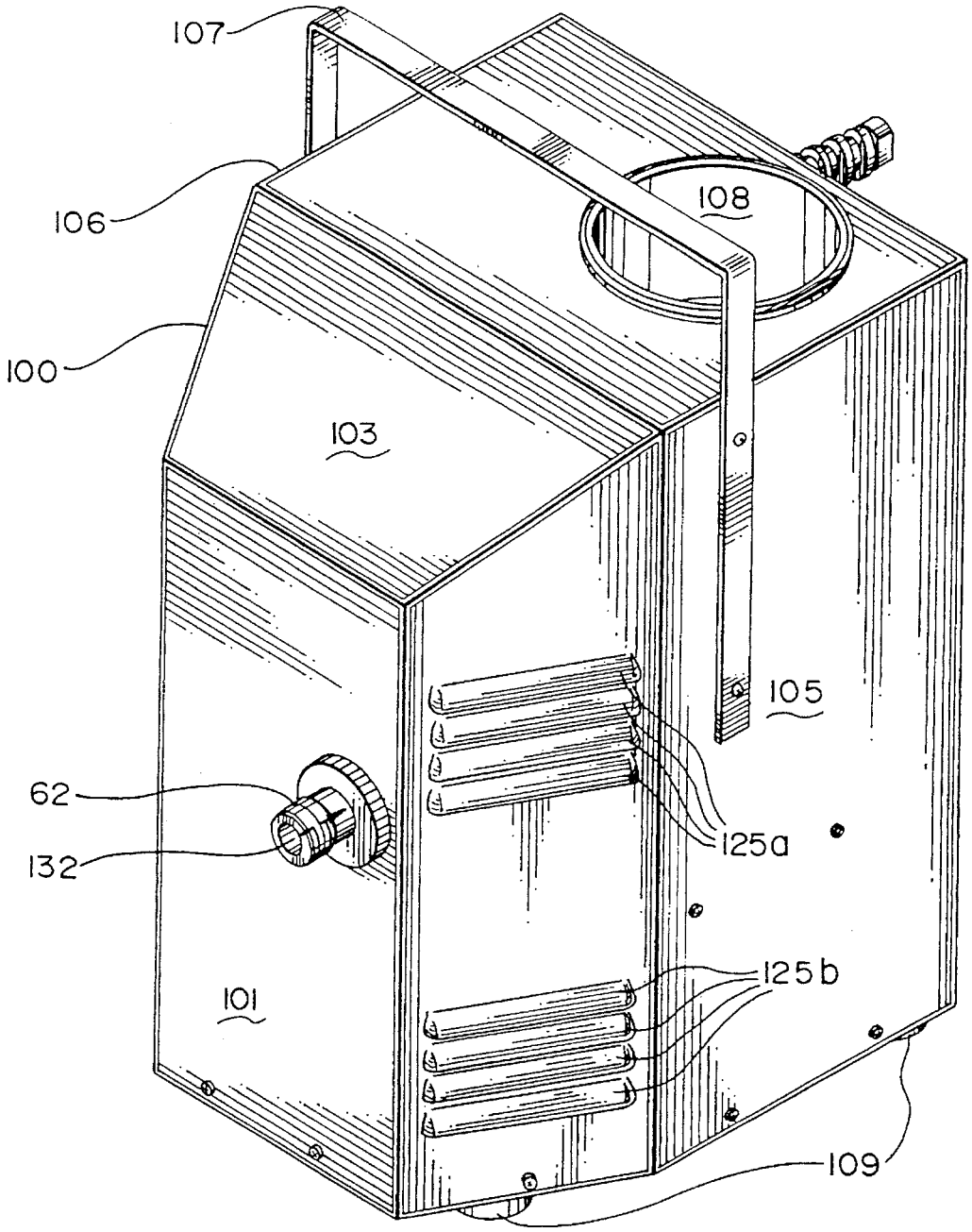
FIG. 1 is a perspective view of one embodiment of the invention.
Figure 3:
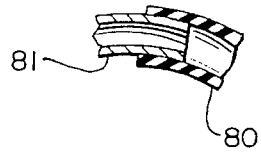
FIG. 3 is a cross-sectional side view of that portion of the invention in FIG. 2 encompassed by the circle marked FIG. 3.

The quieted air compressor assembly 10 includes an air compressor 11 retained within a segregating enclosure (unnumbered) which is equipped with one or more noise abating options including (a) a silencer 40*s* in fluid communication with the primary air intake port 35 of the air compressor 11, (b) a muting tube 80 in sealed fluid communication with a venting port 65 for venting pressurized air from the air compressor 11, (c) a sound absorptive shell 95 lining the segregation enclosure (unnumbered), and (d) a gasketed forth hole 134 through the segregating enclosure (unnumbered) for extension of the motor housing 20 outside the segregation enclosure (unnumbered) which is sized to provide an annular, (unnumbered) around the motor housing 20 and thereby prevent amplification of any motor vibrations through the segregation enclosure (unnumbered).

Figure 2:
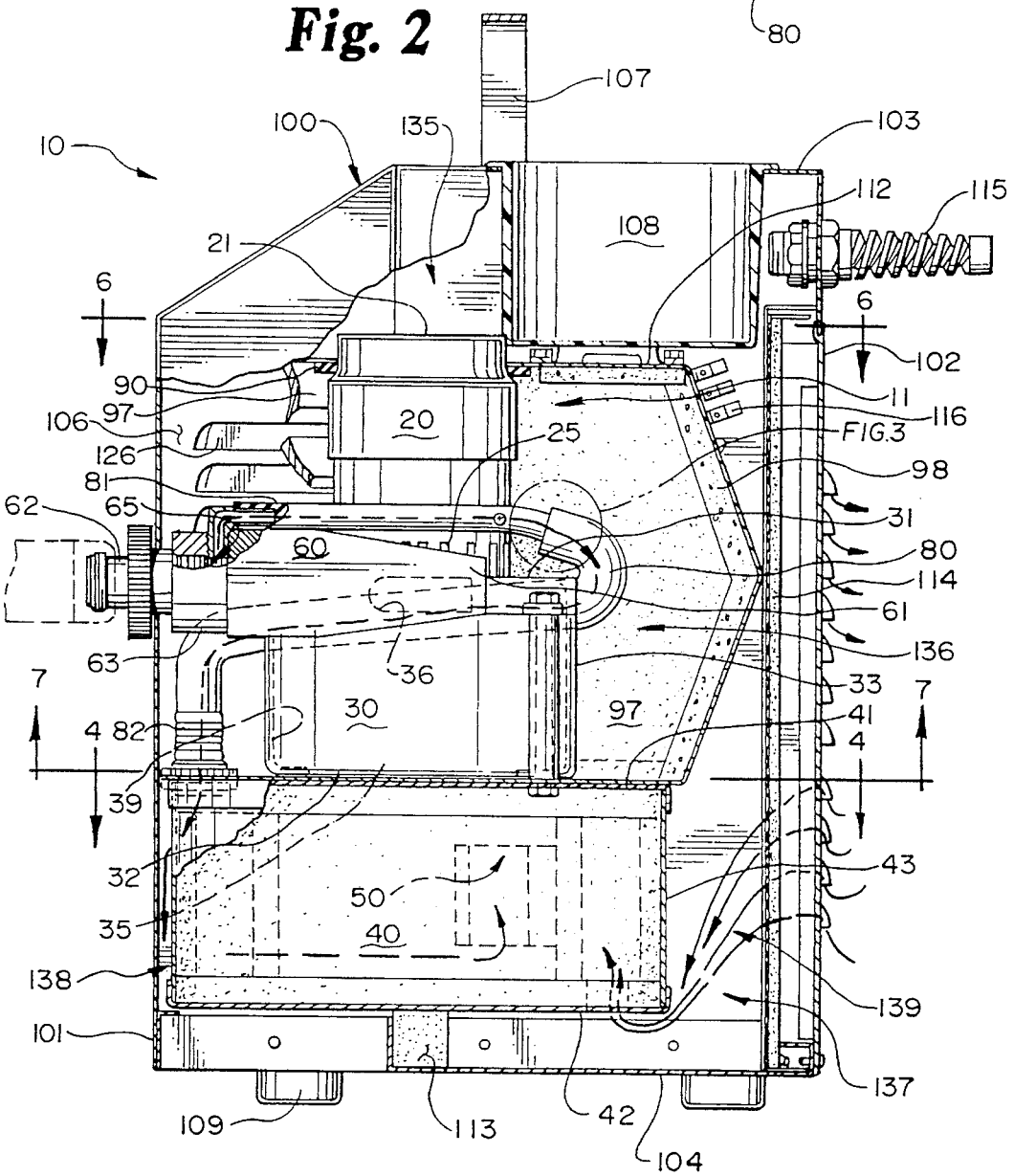
FIG. 2 is a side view of the invention depicted in FIG. 1 with portions of the housing removed to permit depiction of various internal components.
Figure 4:
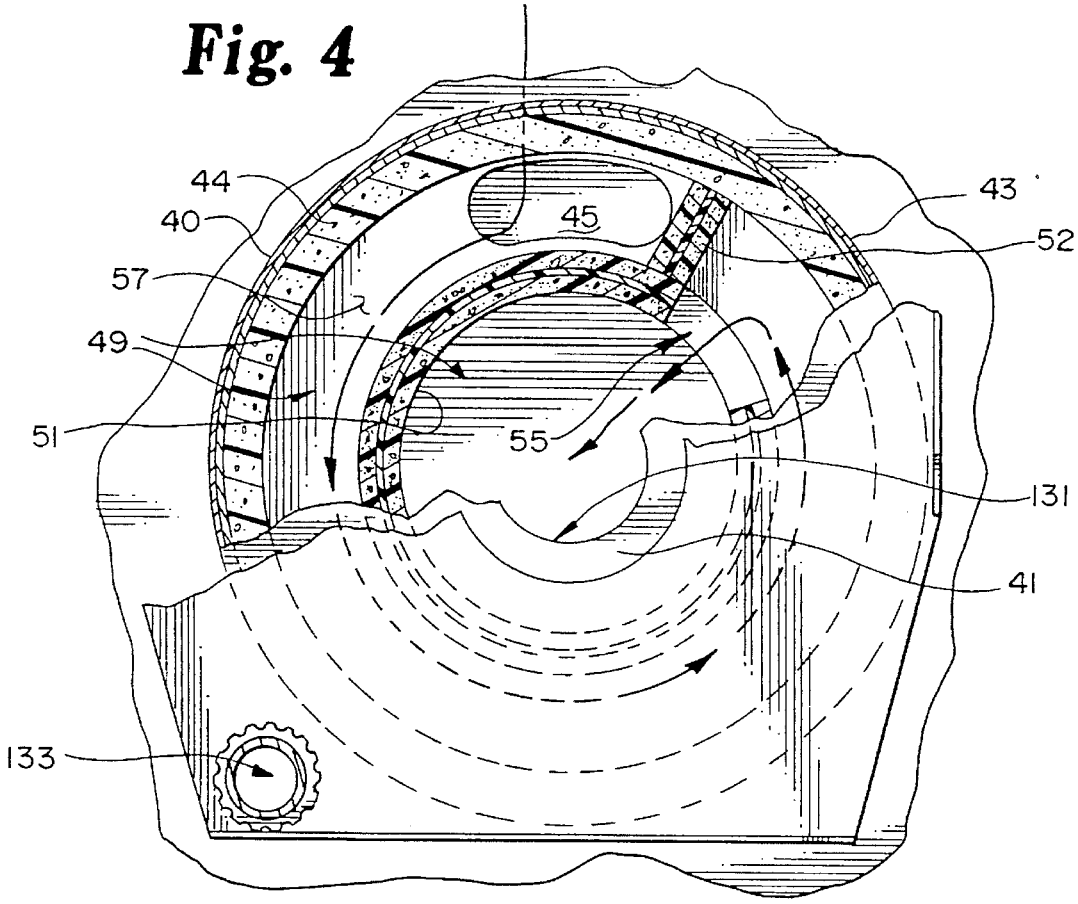
FIG. 4 is a cross-sectional view of the invention depicted in FIG. 2 taken along line 4—4 with portions thereof removed to permit depiction of various internal components.
Figure 5:
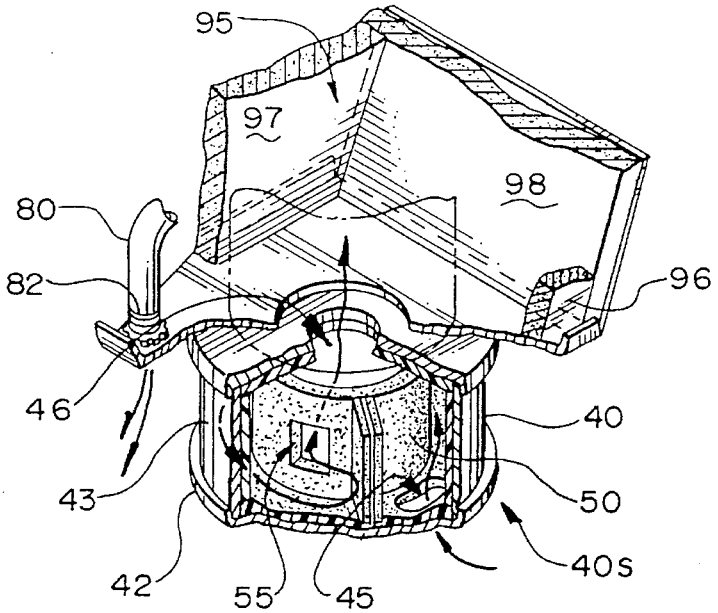
FIG. 5 is a perspective view of the silencer depicted in FIG. 2 with portions thereof removed to permit depiction of various internal components.
Figure 6:
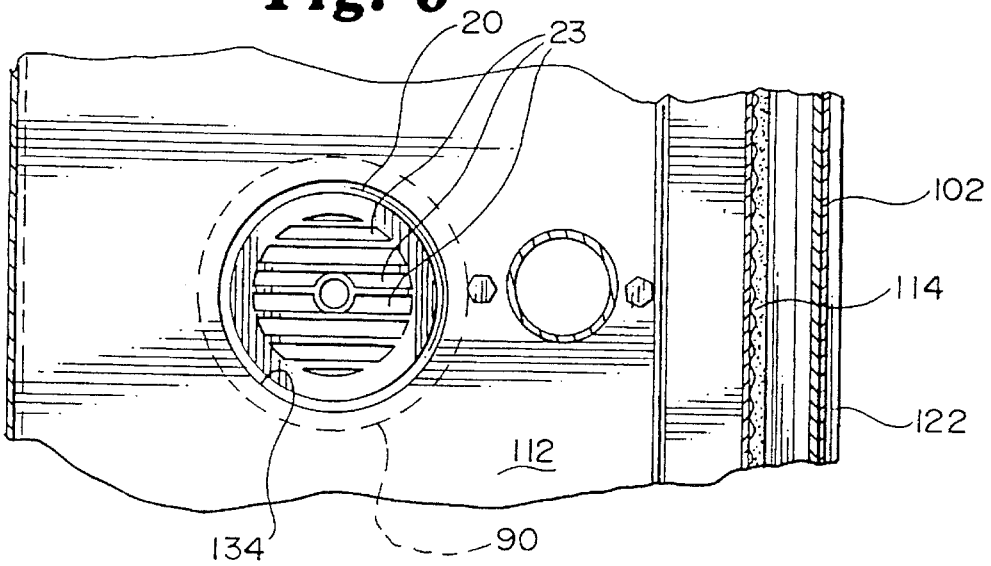
FIG. 6 is a cross-sectional view of the invention depicted in FIG. 2 taken along line 6—6.
Figure 7:
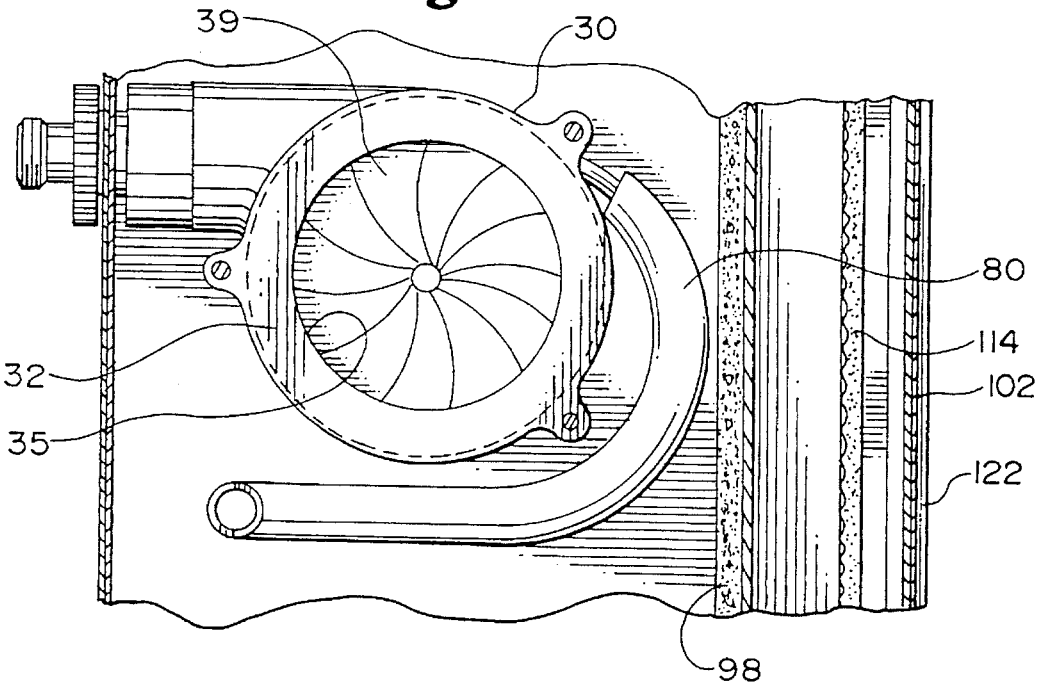
FIG. 7 is a cross-sectional view of the invention depicted in FIG. 2 taken along line 7—7.

Referring generally to FIGS. 1 and 2, the compressor assembly 10 includes a main housing 100 having a front 101, a back 102, a top 103, a bottom 104, a right side 105, and a left side 106.

The main housing 100 is equipped with a handle 107 for facilitating transportation of the assembly 10 and feet 109 for stabilizing the assembly 10 during use. A retention cup 108 is recessed into the top 103 of the main housing 100 for holding a hand held paint sprayer (not shown) or other piece of auxiliary equipment used in combination with the air compressor assembly 10.

A strain releif connector 115 extends through the back 102 of the main housing 100 for guiding electrical wiring from internal electrical connections 116 in the compressor assembly 10 to an external power source.

The main housing 100 is ventilated by louvered air intake ducts 122 extending through the back 102 of the main housing 100, an upper bank of louvered air discharge ducts 125*a* extending through both the right side 105 and left side 106 of the main housing 100 and a lower bank of louvered air discharge ducts 125*b* extending through both the right side 105 and left side 106 of the main housing 100. A standard type air filter 114, such as an open cell foam filter, is positioned immediately behind the air intake ducts 122 for filtering airborne particles from the air stream entering the assembly 10.

The main housing 100 is divided into an upper compartment 135, an intermediate compartment 136, and a lower compartment 137 for protecting and separating the operable components of the air compressor assembly 10. The lower compartment 137 is further divided into a front portion 138 and a rear portion 139 by a divider wall 113.

The upper compartment 135 and rear portion of the lower compartment 137 are commonly ventilated by the louvered air intake ducts 122 in the back 102 of the main housing 100. The intermediate compartment 136 is ventilated by upper banks of louvered air discharge ducts 125*a* in both the right side 105 and left side 106 of the main housing 100 while and front portion 138 of the lower compartment 137 is ventilated by lower banks of louvered air discharge ducts 125*b* in both the right side 105 and left side 106 of the main housing 100. The intermediate compartment 136 is ventilated by upper banks of the louvered air discharge ducts 125*a* on both the right side 105 and left side 106 of the main housing 100 while and front portion 138 of the lower compartment 137 is ventilated by lower banks of louvered air discharge ducts 125*b* in both the right side 105 and left side 106 of the main housing 100.

Silencer

Noise emanating from a primary air intake port 35 of a typical air compressor 11 may be significantly reduced without an appreciable change in the pressure flow curve of the compressor 11 by attaching a silencer 40*s* to the primary air intake port 35.

The silencer 40*s* includes a housing 40 and a baffle 50 lined with a sound absorptive material 44 (hereinafter referenced as acoustical insulation 44). Alternatively, the silencer housing 40 and baffle 50 may be constructed completely from an acoustically insulating material 44.

The silencer housing 40 has a substantially planar top 41 and bottom 42 and a substantially cylindrical sidewall 43 defining a substantially cylindrical silencing chamber 49.

The baffle 50 includes a substantially cylindrically shaped portion 51 generally concentrically positioned within the silencing chamber 49, and a wing portion 52 extending generally radially from the cylindrically shaped portion 51 of the baffle 50 into contact with the silencer housing sidewall 43. The cylindrically shaped portion 51 engages the top 41 and bottom 42 of the silencer housing 40 so as to divide the silencing chamber 49 into a central cylindrical compartment 56 and an annular compartment 57. An opening 55 extends through the cylindrically shaped portion 51 of the baffle 50 proximate the wing portion 52 of the baffle 50 for permitting fluid communication between the central cylindrical compartment 56 and the annular compartment 57.

An inlet orifice 45 extends through the bottom 42 of the silencer housing 40 into fluid communication with the annular compartment 57 of the silencing chamber 49. Similarly, an outlet orifice 46 extends through the top 41 of the silencer housing 40 into fluid communication with the central cylindrical compartment 56 of the silencing chamber 49.

The inlet orifice 45 through the silencer housing 40 and the opening 55 through the baffle 50 are radially positioned next to each other with the wing portion 52 of the baffle 50 positioned between them. The wing 52 prevents air from flowing directly between the inlet orifice 45 and the opening 55 so that air flowing into the silencing chamber 49 through the inlet orifice 45 must travel along substantially the entire circumference of the annular compartment 57 to reach the opening 55 through the baffle 50. This pathway increases the surface area (sabins) available for noise absorption before the air flows into the central cylindrical compartment 56 of the silencing chamber 49 and out of the silencer 40*s* through the outlet orifice 46.

Acoustical insulation 44 is provided along the inner surfaces (unnumbered) of the top 41, bottom 42, and sidewall 43 of the silencer housing 40 and on both sides (unnumbered) of both the cylindrical portion 51 and wing portion 52 of the baffle 50.

Acoustical insulation includes four general categories of materials: sound absorbent, sound reflective, damping, and vibration isolation. The acoustical insulation of interest for use in the silencer 40*s* of this invention is of the sound absorption type.

The most common types of sound absorptive materials are those possessing an open-celled porous structure. Sound energy enters the interconnecting pores of porous materials where it causes rapid air movement. Such rapid air movement converts the sound energy into heat energy by frictional and viscous forces which operate at the air-to-material interface.

The amount of acoustic energy dissipated by a sound absorbent material is a function of the physical properties of the material and the nature of the sound field. Accordingly, selection of the most suitable acoustic insulation for a given situation requires an assessment of the sound field to be abated.

Thousands of different types of materials are effective for absorbing sound including woven fabrics, felts such as wool, fibrous thermal insulation materials such as rock wool, and open-celled foams such as foamed polyurethane. However, only a small portion of these materials are actually marketed as acoustical insulating materials.

The fibrous material most often employed as an acoustical insulating material is glass fiber. The fibers are usually coated with a binder material to hold the fibers together and faced with a low flow resistant covering to reduce erosion. Fibrous glass is a relatively inexpensive sound absorbent material but tends to shred, settle and/or erode in the presence of a high velocity air flow despite use of a binder and/or covering.

Plastic acoustic foams must have an open-cell structure to be suitable for use as a sound absorbing material. In other words, the contact planes between the cells formed within the plastic must be open to permit the flow of air between cells.

The silencer housing 40 and baffle 50 may be constructed completely from a plastic foam but are preferably constructed from a more rigid material which is then lined with plastic foam. Rigid materials from which the housing 40 and baffle 50 may be constructed include specifically, but not exclusively; metals such as aluminum or steel; and plastics such as polyvinylchloride or polyester.

Muting Tube

A conduit 60 extends from the primary air discharge port 36 of the pressurizing enclosure 30 through a second hole 132 in the front 101 of the main housing 100 for directing pressurized air from the compression chamber 39 to a pressure hose coupling 69 positioned outside of the main housing 100.

A venting port 65 is provided through the sidewall 63 of the conduit 60 for venting pressurized air from the system. Such venting permits a continuous flow of air through the air compressor 11 even when a spray gun (not shown) in sealed fluid communication with the distal end 62 of the conduit 60 is closed to air flow as occurs with conventional "non-bleeder" type spray guns (not shown). Venting of pressurized air under such circumstances avoids overspeeding and overheating of the air compressor 11.

The venting port 65 is positioned within the intermediate compartment 136 so that any noise generated by the venting of pressurized air through the venting port 65 is reduced by the sound absorptive shell 95 within the main housing 100 before being released into the surrounding environment.

The proximal end 81 of a muting tube 80 is sealingly coupled by means of a barbed elbow 70 to the venting port 65. The distal end 82 of the muting tube 80 is sealingly coupled by means of a threaded nut to a third hole 133 through the first partition 111 in the main housing 100. The muting tube 80 directs vented air from the intermediate compartment 136 into the front portion 138 of the lower compartment 137 in order to prevent the warmed vented air from collecting in the intermediate compartment 136 and thereby further elevating the temperature of the air compressor 11.

The muting tube 80 has an internal diameter (83, 84) which increases as the muting tube 80 extends away from the venting port 65. The internal diameter (83, 84) of the muting tube 80 is increased by a factor of at least 1.5, preferably at least 2, and most preferably at least 3. Such an increase in the internal diameter (83, 84) reduces the noise level emitted into the surrounding environment by the discharge of pressurized air through from the venting port 65. Such an increase in the internal diameter from the smaller diameter 83 to the larger diameter 84 of the muting tube 80 may be effected either gradually or in a step-wise fashion.

Discharge of the warmed vented air into the front portion 138 of the lower compartment 137 prevents the warmed vented air from being immediately reintroduced into the air compressor 11 through the primary air intake port 35 where it would tend to increase the operating temperature of the air compressor 11.

Shell

The intermediate compartment 136 is defined by the front 101, right side 105 and left side 106 of the main housing 100 and the first partition 111 and second partition 112. The air compressor 11, including both the motor (not shown) and blades (not shown), are retained within the intermediate compartment 136. Accordingly, a large portion of the noise generated by the air compressor assembly 10 originates from within the intermediate compartment 136.

The noise level emitted into the surrounding environment from the intermediate compartment 136 may be reduced by positioning a sound absorptive shell 95 within the intermediate compartment 136. The sound absorptive shell 95 may be readily laminated over the right side 105, left side 106 and back (unnumbered) as there are no components extending through these walls. The other walls may be covered with the sound absorptive shell 95 as well but must be trimmed and configured to accommodate the various openings and components extending through those walls.

As with the acoustical insulation used in the silencer 40*s*, the acoustical insulation of interest for use as the sound absorptive shell 95 is preferrably about 4 to about 5 inch thick open celled plastic foam.

Gasketed Opening

The remote end 21 of the motor housing 20 extends from the intermediate compartment 136 into the upper compartment 135 through a fourth hole 134 in the second partition 112. The remote end 21 includes a plurality of air intake vents 23 and a small cooling fan (not shown) for drawing air from the upper compartment 135 into the motor housing 20 and out through a plurality of air discharge vents 25 near the proximal end 22 of the motor housing 20. The air flowing through the motor housing 20 serves to cool the motor (not shown) during operation of the air compressor 11.

The fourth hole 134 through the second partition 112 is sized to provide an annular gap completely around the motor housing 20 and thereby prevent the transmission of any motor vibrations from the motor housing 20 to the second partition 112.

Segregation of the upper compartment 135 and intermediate compartment 136 is maintained by a resilient gasket 90 adhesively bonded to the underside of the second partition 112 and positioned over the annular gap. The gasket 90 seals the gap to air flow without transmitting substantial vibrational movement from the motor housing 20 to the second partition 112.

OPERATION

Pressurized Air

Atmospheric air is drawn into the pressurizing enclosure 30 by a plurality of rotating blades (not shown) mounted within the pressurizing enclosure 30. The atmospheric air flows into the pressurizing enclosure 30 (i) through the louvered air intake ducts 122 and air filter 114 at the back 102 of the main housing 100, (ii) into the rear portion 139 of the lower compartment 137, (iii) through the inlet orifice 45 in the bottom 42 of the silencer housing 40, (iv) around the annular compartment 57 of the silencing chamber 49, (v) through the opening 55 in the baffle 50, (vi) up the central cylindrical compartment 56 of the silencing chamber 49, and (vi) through the outlet orifice 46 in the silencer housing 40, the first hole 131 in the first partition 111, and the primary air intake port 35 in the pressurizing enclosure 30.

Pressurized air exits the pressurizing enclosure 30 through the primary air discharge port 36 and is directed to a spray gun (not shown) located externally from the main housing 100 by an air conduit 60 and a pneumatic hose (not shown).

Cooling Air

Atmospheric air is drawn into the motor housing 20 by a fan (not shown) mounted near the remote end 21 of the motor housing 20. Atmospheric air flows into the motor housing 20 (i) through the louvered air intake ducts 122 and air filter 114 at the back 102 of the main housing 100, (ii) into the upper compartment 135 of the main housing 100, and (iii) through the air intake vents 23 in the remote end 23 of the motor housing 20.

The cooling air is then discharged from the motor housing 20 into the intermediate compartment 136 of the main housing 100 through air discharge vents 25 in the motor housing 20. The cooling air exits the intermediate compartment 136 through the upper banks of air discharge ducts 125*a* which extend through the right side 105 and left side 106 of the main housing 100.

The foregoing specification provides a complete description of the construction and operation of one embodiment of the invention. Since many variations and embodiments of the invention may be made without departing from the spirit and scope of the invention, the invention resides in the claims hereinafter appended.

What is claimed is:

1. An assembly comprising:

(a) an air compressor retained within a pressurizing enclosure; the air compressor having a primary air intake port, and (b) a silencer in direct fluid communication with the primary air intake port which comprises at least:

(1) a housing defining a silencing chamber and including a sound absorbent material, (2) an inlet orifice through the housing, (3) an outlet orifice through the housing, and (4) a baffle positioned within the silencing chamber forming a circuitous path within the silencing chamber from the inlet orifice to the outlet orifice; the baffle including a sound absorbent material.

2. The assembly of claim 1 wherein:

(a) the air compressor is incorporated into a paint sprayer, (b) the housing includes first and second substantially planar ends and a substantially cylindrical sidewall which define a substantially cylindrical silencing chamber, (c) the inlet orifice extends through the first end of the housing, (d) the outlet orifice extends through the second end of the housing, and (e) the baffle includes:

(1) a substantially cylindrically shaped portion generally concentrically positioned within the silencing chamber and extending between the first and second ends of the housing dividing the silencing chamber into a central cylindrical compartment in direct fluid communication with the outlet orifice and an annular compartment in direct fluid communication with the inlet orifice, (2) an opening through the baffle positioned proximate the inlet orifice, and (3) a wing extending generally radially from the cylindrically shaped portion of the baffle into sealing contact with the housing; the wing positioned within the annular compartment between the inlet orifice and the opening through the baffle such that air flowing into the chamber through the inlet orifice must travel along substantially the entire circumference of the annular compartment before entering the central cylindrical compartment through the opening.

3. The assembly of claim 1 wherein (i) the housing is formed of a fixed-shape framework lined with the sound absorbent material, and (ii) the baffle is constructed solely of sound absorbent material.

4. The assembly of claim 2 wherein (i) the housing is formed of a fixed-shape framework lined with the sound absorbent material, and (ii) the baffle is constructed solely of sound absorbent material.

5. The assembly of claim 1 wherein the sound absorbent material is an open celled foam.

6. The assembly of claim 2 wherein the sound absorbent material is an open celled foam.

* * * * *